United States Patent [19]

Holmes et al.

[11] Patent Number: 5,037,274

[45] Date of Patent: Aug. 6, 1991

[54] PERISTALTIC APPARATUS AND METHOD FOR PUMPING AND/OR METERING FLUIDS

[75] Inventors: Elmond A. Holmes, Fullerton, Calif.; Gilson H. Rohrback, Seattle, Wash.

[73] Assignee: Infometrix, Incorporated, Seattle, Wash.

[21] Appl. No.: 446,475

[22] Filed: Dec. 5, 1989

[51] Int. Cl.[5] ..... F04B 43/12

[52] U.S. Cl. ..... 417/53; 417/475; 417/477

[58] Field of Search ..... 417/53, 474–477; 604/153

[56] References Cited

U.S. PATENT DOCUMENTS

| | | | |
|---|---|---|---|
| 3,046,903 | 7/1962 | Jones | 417/475 X |
| 3,105,447 | 10/1963 | Ruppert | 417/475 |
| 4,515,589 | 5/1985 | Austin et al. | 417/477 X |
| 4,540,350 | 9/1985 | Streicher | 417/477 X |
| 4,548,553 | 10/1985 | Ferster | 417/477 |
| 4,586,882 | 5/1986 | Tseng | 417/477 |
| 4,650,471 | 3/1987 | Tamari | 417/475 X |
| 4,728,265 | 3/1988 | Cannon | 417/474 X |

FOREIGN PATENT DOCUMENTS

| | | | |
|---|---|---|---|
| 3320090 | 12/1984 | Fed. Rep. of Germany | 417/477 |
| 2595765 | 9/1987 | France | 417/477 |
| 56-151289 | 11/1981 | Japan | 417/477 |
| 2128262 | 4/1984 | United Kingdom | 417/475 |

OTHER PUBLICATIONS

Article Entitled "As the Tubing Goes, So Goes the Pump", pp. 78 through 83, R&D (Research & Development) Magazine (a Cahner's publication), Jun., 1989.

*Primary Examiner*—Leonard E. Smith
*Assistant Examiner*—Eugene L. Szczecina, Jr
*Attorney, Agent, or Firm*—Poms, Smith, Lande & Rose

[57] ABSTRACT

A peristaltic pumping and metering apparatus and method whereby tube walls are squeezed inwardly against cores contained in the tubes. A plurality of rings are frictionally driven in epicyclic manner, to thus deform a contoured belt against the core-containing tubes.

18 Claims, 1 Drawing Sheet

FIG. 1.
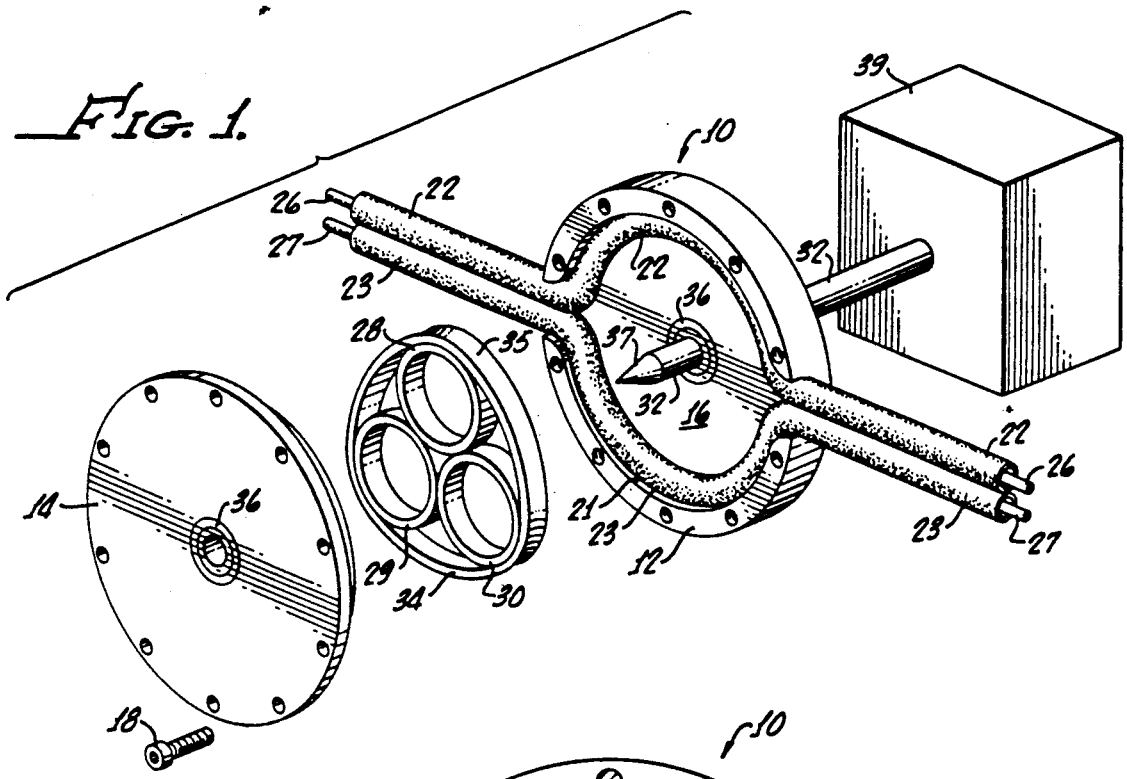
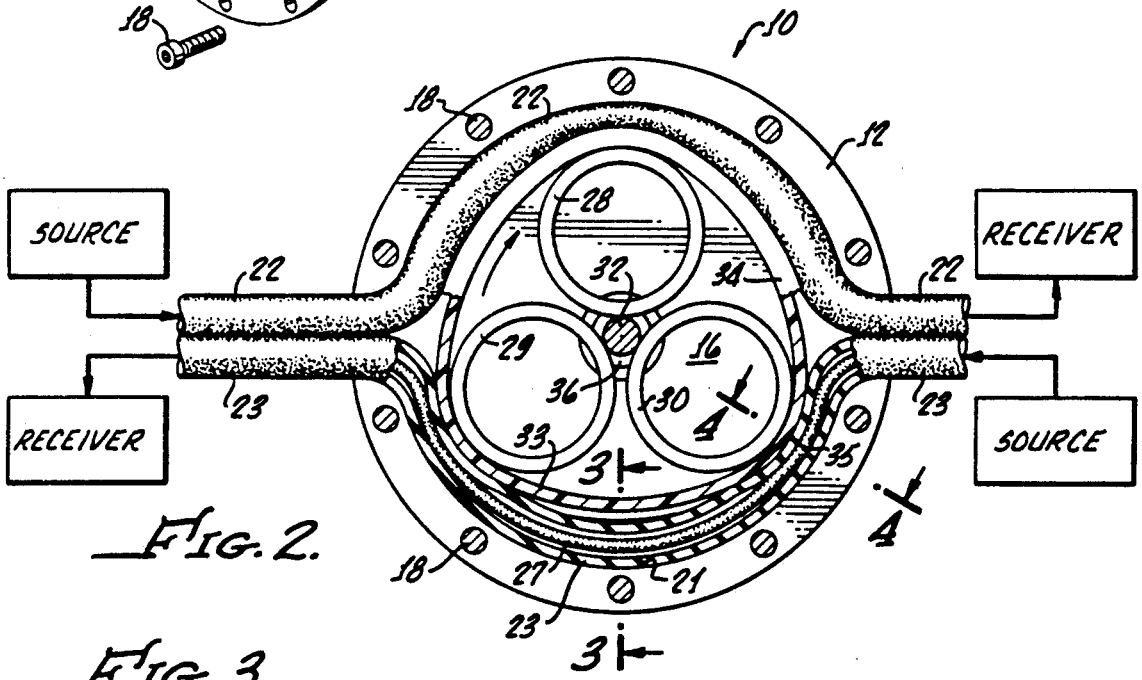
FIG. 2.
FIG. 3.
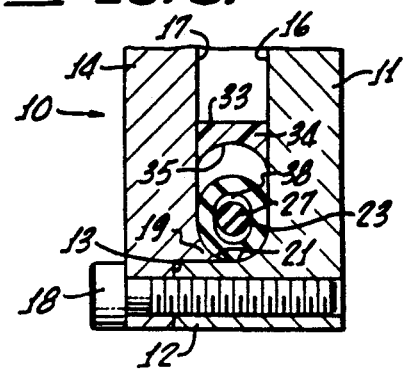
FIG. 4.
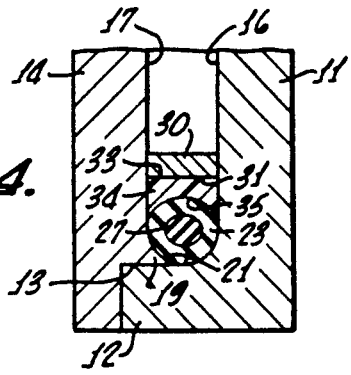

PERISTALTIC APPARATUS AND METHOD FOR PUMPING AND/OR METERING FLUIDS

BACKGROUND OF THE INVENTION

There is a major need for peristaltic pumps the tubes of which will last longer than those of prior-art peristaltic pumps. Various tube materials have been employed in an effort to increase tube life and achieve other benefits, but despite such materials the problem of wear continues to be a major one.

It is conventional in peristaltic pumps to flatten or "pinch" tube walls against a surface. The relationships between the parts may be such that the tube is partially occluded, fully occluded, or over occluded. Flexural fatigue occurs where the tube is repeatedly creased, and this and other factors cause spallation of the inner surface of the tube. Shedding of tube particles from the inner wall of the tube is a problem not only because of decreased tube life, but because the interior size of the tube can be caused to vary in an irregular manner—thus creating changed and/or unpredictable flow rates. The repeated creasing of the tube, as it is flattened against a back-up surface, can also cause cracking of the tube, or permanent deformation thereof with consequent diminished flow rate.

It is important that an apparatus and method be provided by which the tendencies toward fatigue, spallation, cracking, permanent deformation, and variations in flow rate are minimized. It is also important that this be achieved in a simple and effective manner having no major effect on the cost of the peristaltic pump or meter.

Relative to another aspect of the invention, it is desired to provide an extremely simple peristaltic pump that in many instances does not require gearing, and does not require complex components. It is also desired that the simple and economical arrangement of parts be such that fluid may be pumped or metered in opposite directions simultaneously, and with minimized creep or crawl of the tubes.

SUMMARY OF THE INVENTION

In accordance with one aspect of the present apparatus and method, the occlusion of the tube in a peristaltic pump or meter is effected by squeezing the tube inwardly toward an internal core.

In accordance with another aspect of the apparatus and method, a means and method are provided to achieve effective squeezing of the tube so as to engage the core around the full perimeter thereof, the relationships being such that the region of engagement progresses along the tube so as to achieve pumping.

In accordance with a further aspect of the invention, a central shaft is driven by a motor and is in pressurized friction engagement with peripheral regions of rings, the outer portions of the rings being associated with the tubes so as to achieve a peristaltic pumping or metering action when the rings are rotated by the central shaft.

In accordance with a further aspect of the invention, a belt is provided between the drive means and the tubes, the belt being configured to cooperate with other means in achieving effective squeezing of the tubes as distinguished from pinching thereof.

BRIEF DESCRIPTION OF THE DRAWINGS

FIG. 1 is an isometric view, partially exploded, showing a peristaltic pump or meter constructed in accordance with a preferred embodiment of the invention;

FIG. 2 is a view showing the pump components, excepting the front cover, in assembled relationship and as employed to pump or meter fluid in opposite directions between source and receiver means;

FIG. 3 is a transverse sectional view on line 3—3 of FIG. 2; and

FIG. 4 is a transverse sectional view on line 4—4 of FIG. 2.

DETAILED DESCRIPTION OF THE PREFERRED EMBODIMENT

The illustrated apparatus comprises a generally disc-shaped housing 10 having an inner wall 11. A circular flange 12 is formed integrally with the periphery of wall 11, such flange extending at its outer regions into an annular groove or recess 13 (FIGS. 3 and 4) in the peripheral portion of the outer wall 14 of housing 10. The opposed surfaces 16,17 of the inner and outer walls 11,14, respectively, are parallel to each other (except peripherally, as stated below) and are spaced a predetermined distance apart. Outer wall 14 is secured to the flange 12 and to wall Il by a plurality of cap screws 18 that are spaced about the flange.

As shown in FIGS. 3 and 4, which are radial sections, the peripheral regions of surfaces 16,17 are radiused in such manner that they cooperatively (in such sections) define a large arc of a circle. The diameter of the circle is generally equal to the distance between surfaces 16,17 at the planar portions thereof. Stated otherwise, at its periphery the inner surface 16 of wall 11 is concavely radiused as is the inner surface of flange 12, forming a generally ninety-degree radius. Furthermore, at the outer region of wall 14 is formed a generally cusp-like protuberance 19 the inner surface of which is radiused generally ninety degrees so as to cooperate with the radius on inner wall 11 and flange 12 to form a generally one hundred eighty-degree wall 21. This wall 21 serves as the backup and squeeze wall for tubes next described.

Upper and lower resilient tubes 22,23 are mounted, respectively, adjacent the upper and lower portions of the backup and squeeze wall 21. At diametrically-opposite portions of housing 10, the tubes 22,23 come together and pass outwardly from housing 10 through gaps in flange 12. At regions exteriorly adjacent the housing, the tubes 22,23 are secured to each other (by means, not shown) so as to minimize any tendency toward creeping of the tubes 22,23 relative to the housing.

Tubes 22,23 have elongate cores 26,27 mounted therein and extending longitudinally thereof. Lower core 27 is shown in section in FIGS. 3 and 4, and in side elevation in FIG. 2.

It is to be understood that the illustrated housing and tube apparatus is symmetrical about a plane containing the axis of the chamber defined by housing 10, such axial plane (not shown) being horizontal when the parts are in the positions shown in FIG. 2. If sections were taken in the housing and tube portions above the indicated plane, that is to say relative to upper tube 22 and its core 26, and relative to the upper part of housing 10, such sections would be similar to those shown in FIGS. 3,4 and at the lower portion of FIG. 2.

Means additional to wall 21 are provided to effect squeezing of the respective tubes 22,23, and to cause progressive movement of the squeezed regions therealong. In the illustrated preferred embodiment, such means comprises a plurality of rings that transmit force outwardly from a central drive element to the sides of tubes 22,23 that are relatively close to such drive element. In addition, the rings revolve and rotate in orbital manner about the central drive element.

In the illustrated embodiment, there are three such rings 28–30 the axes of which are spaced 120° from each other. The outer surfaces 31 (FIG. 4) of the rings are cylindrical when the rings are in free (uncompressed) condition. The ring surface regions relatively adjacent the axis of the chamber are in bearing engagement with a central drive shaft 32 having a cylindrical exterior surface. The outer regions of the rings 28–30, relatively adjacent the tubes 22,23, bear against the interior cylindrical surface 33 of a flexible belt 34.

The exterior surface 35 of belt 34 is shaped to engage the tubes 22,23 and to cooperate with the backup and squeeze wall 21 in squeezing the tubes so that their interior surfaces are closely adjacent to, and normally engage, cores 26,27. As shown in FIGS. 3 and 4, the exterior belt surface is, in transverse section, a large concave arc of a circle.

The drive shaft 32 rotates in bearings 36 in housing walls 11 and 14. Such shaft has a pointed or convergent end 37 (or, alternatively, has such a pointed end removably secured thereto coaxially thereof), so that shifting of shaft 32 to the left as viewed in FIG. 1 causes the end 37 to enter the central space defined by rings 28–30 and cam such rings apart. The rings are thus spread from the FIG. 1 position (at which the rings are in engagement with each other) to the FIG. 2 position (at which the rings engage only the shaft 32 and the belt 34).

The belt 34 has sidewalls that are parallel to surfaces 16,17 of the housing and are free sliding fits relative to such surfaces. Similarly, rings 28–30 have end walls that are free sliding fits relative to surfaces 16,17.

DESCRIPTION OF THE METHOD

Stated generally, the method comprises providing an elongate core longitudinally in a tube having a flexible wall, the relationships being such that a fluid-receiving pumping or metering space is defined between the exterior core surface and the interior tube surface. The method further comprises progressively squeezing the tube to occlude such space, and to cause the region of occlusion to progress along the tube so as to achieve a pumping and/or metering function.

Preparatory to performing the method by use of (for example) the described apparatus, the cores 26,27 are threaded through tubes 22,23, and the tubes and contained cores are mounted in the housing at the junction between wall 11 and flange 12. Thereafter, the belt 34 is inserted inwardly of the respective tubes, following which the three rings 28–30 are introduced into the belt 34. The outer wall 14 of the housing 10 is then mounted onto flange 12 by means of screws 18. Thereafter, shaft 34 is inserted through bearings 36 of both housing walls 11 and 14, the pointed end 37 (FIG. 1) then spreading the rings 28–30 apart as described above.

Alternatively, the steps preparatory to performing the method, with the illustrated apparatus, may include assembling the tubes 22,23 around belt 34 before insertion of the tubes and belt into the space defined by wall 11 and flange 12. The belt then holds the tubes against the backup and squeeze wall 21 while the rings 28–30 are introduced into the belt. The outer wall 14 is then mounted, and the shaft 32 is inserted, as described above.

The method (and the apparatus) further comprises so selecting the dimensions of the parts that each tube will be occluded, preferably fully occluded, adjacent the region where the actuation means engages the belt. This is shown in FIG. 4, which illustrates how the opposed walls or surfaces 21 and 35 engage opposite sides of the exterior tube surface and choke or squeeze the tube against the core 27. The method further comprises so selecting and dimensioning the components that, when the actuation means is not present, the tube 23 largely separates from the core 27 to provide a space 38 (FIG. 3) that receives the fluid being pumped and/or metered. (As above noted, the construction and operation relative to upper tube 22 and core 26 are the same as that described relative to the lower tube and core.)

The diameter of the core is sufficiently smaller than that of the inner tube wall, when the tube is not being choked, to provide a substantial and significant flow space. On the other hand, it is preferred that the core diameter be sufficiently large that the inner tube wall may be effectively squeezed against it about the full perimeter or circumference thereof.

When a motor 39, that is connected to shaft 32 with or without gearing, is operated, the shaft 32 rotates in bearings 36 to drive the rings 28–30 in an epicyclic manner. Let it be assumed that the direction of rotation of shaft 32 is clockwise so that the rings revolve about shaft 32 in a clockwise direction as viewed in FIG. 2, each ring then rotating counterclockwise about its own axis. The driving is frictional. There is a large mechanical advantage that can eliminate the need for gearing in the motor 39, as above indicated.

As the rings roll along the interior belt surface 33 (FIGS. 3 and 4), they force belt regions outwardly to the positions shown in FIGS. 2 and 4, and to an infinite number of other positions, thus squeezing or choking the respective tubes 22,23 against the cores 26,27 therein and forcing the fluid along the tubes.

The fluid in upper tube 22 is forced to the right, while that in the lower tube is forced to the left. Thus, as shown in FIG. 2, a fluid source is schematically represented at the upper left as being connected to upper tube 22, so that the shaft rotation causes fluid to be pumped from such upper-left source to a receiver indicated at the upper right. Conversely, relative to the lower tube, fluid is pumped from a source shown at the lower right to a receiver shown at the lower left.

When one or both of the receivers is pressurized to a sufficient pressure, the movement of the points of squeezing or choking effects only metering, since the moving choke regions effectively limit and meter the flow of fluid from the sources to the receivers.

It is emphasized that, in accordance with the present method and apparatus, the tube walls are not creased. There is a minimum tendency toward spallation or cracking of the tubes, with consequent increased tube life and--furthermore--increased constancy of the flow volume of space 38 (FIG. 3) defined between tube and core. The result is a long-lasting, accurate-metering system. The flow volume can be kept large, despite the core, with only relatively small increases in tube diameter. This is because the squaring of the radiuses, when calculating areas, causes the "annulus" area to be much more significant than core area (in cross-section).

ADDITIONAL DISCLOSURE

It is possible but not preferred to omit the belt 34, in which case the drive elements themselves should be so configured as to effect the indicated squeezing or choking action--as distinguished from a pinching action by which the tubing is flattened.

Oil or grease may be employed in the chamber defined by housing 10, but not in such amount or relationship as to interfere with the stated driving of the rings.

The present apparatus and method not only increase tube life, but increase the volumetric accuracy of the pumping or metering operation.

The present method effects compressing of a tube onto a (preferably) coaxial core, to effect occlusion or closure without creasing or pinching.

A wave motion may also be achieved, by progressively actuating a substantial number of closely adjacent squeezing elements, thus pumping or metering the fluid without actually causing motion of an actuator longitudinally of the tube and core.

When the rings 28–30 are installed, and the shaft 32 is driven, the rings are spread and the belt is caused to close the tube at two or more places, and also to release the tubing at regions between such places.

Preferably, the rings 28–30 are caused to be somewhat resilient or springy so that they deform slightly in response to the pressure that is caused to be present. However, the relationships are such that there is insufficient pressure to cause excessive squeezing of the walls of the tube, to thus minimize spallation.

As an example, each tube may be formed of silicone rubber, and may have a ⅛ inch inner diameter, when in free condition, and a 1/16 inch wall thickness. The core 26 or 27 is Buna-n synthetic rubber the hardness of which is 40 durometer, the diameter being 0.103 inch.

The cores 26,27 are preferably cylindrical in shape, although they may have various other configurations.

The tubes 22,23 are preferably cylindrical in shape when in free condition (and not compressed by the walls 16,17). Preferably, the walls 16,17 are sufficiently close to each other that the tube is caused to be somewhat radially prolate, as illustrated in FIG. 3.

Preferably, the rings are maintained in precisely-spaced relationship by three idler rollers respectively disposed therebetween. Such idlers rotate on fixed pins on a rotating backplate, the backplate being rotatably centered on the center shaft.

The foregoing detailed description is to be clearly understood as given by way of illustration and example only, the spirit and scope of this invention being limited solely by the appended claims.

What is claimed is:

1. A method of pumping and metering a fluid, which comprises:

providing a resilient tube, providing in said tube, longitudinally thereof, an elongate core the outer diameter of which is substantially smaller than the inner diameter of said tube when said tube is in free condition, whereby to define a fluid-receiving space in said tube exteriorly of said core when said tube is in free condition, connecting said space to a source of fluid to be pumped or metered, and effecting progressive squeezing of said tube such that the squeezed region moves longitudinally of said tube in a direction away from said source, said squeezing reducing the size of said fluid-receiving space at said squeezed region to thus achieve a peristaltic pumping or metering action relative to the fluid in said source.

2. The invention as claimed in claim 1, in which said progressive squeezing step is so performed that said tube at said squeezed region is choked sufficiently that the interior wall of said tube is in substantially continuous contact with said core, about the full perimeter of said core.

3. The invention as claimed in claim 2, in which said method further comprises employing as said tube a tube having a generally cylindrical interior wall when in free condition, and further comprises employing as said core a core having a generally cylindrical exterior wall.

4. The invention as claimed in claim 1, in which said method further comprises effecting said squeezing by pressing a transversely contoured actuator element against said tube to press the tube wall toward said core.

5. The invention as claimed in claim 4, in which said method further comprises employing as said actuator element a flexible member, one side of said member being so contoured as to squeeze the engaged tube wall region against the core wall opposed thereto, and in which said method further comprises providing means to force said actuator element toward said tube at regions progressively farther from said source.

6. The invention as claimed in claim 4, in which said method further comprises providing a transversely contoured backup surface on the opposite side of said tube from said actuator element, and selecting the contours of said actuator element and backup surface, and the exterior configuration of said core, in such manner as to achieve effective choking of said tube against said core.

7. The invention as claimed in claim in which said method further comprises pressurizing said source sufficiently that the above-recited steps of said method achieve only a metering function.

8. Peristaltic apparatus, which comprises:

a tube having a resilient wall, an elongate core mounted in said tube longitudinally thereof, the outer diameter of said core being substantially smaller that the inner diameter of said tube wall, whereby a fluid-receiving space is defined between said core and the interior surface of said tube wall, a fluid source, of fluid to be pumped, connected to said space, and means to effect squeezing of said tube at at least one region therealong, to substantially occlude said fluid-receiving space.

9. The invention as claimed in claim 8, in which said means to effect squeezing of said tube effects progressive squeezing of said tube in such manner that the squeeze region moves longitudinally of said tube in a predetermined direction.

10. The apparatus as claimed in claim 8, in which said means to effect squeezing is such that said tube at the squeezed region is choked sufficiently that the interior wall of said tube is in substantially continuous contact with said core about the full perimeter of said core.

11. The invention as claimed in claim 10, in which the interior surface of said wall, when said wall is in free condition, is generally cylindrical, and in which said core has a generally cylindrical exterior wall.

12. The invention as claimed in claim 8, in which said apparatus further comprises a transversely contoured actuator element to press said tube wall toward said core.

13. The invention as claimed in claim 12, in which said actuator element is a flexible member, one side of said member being so contoured as to squeeze the engaged tube wall region against the opposed core wall, and in which said apparatus further comprises means to force said actuator element toward said tube at regions progressively farther from said source.

14. The invention as claimed in clam 12, in which said apparatus further comprises means to provide a transversely contoured backup surface on the opposite side of said tube from said actuator element, the contours of said actuator element and backup surface, and the exterior configuration of said core, being such as to achieve effective choking of said tube against said core.

15. A peristaltic pumping and metering apparatus, comprising:

backup means to provide support for one side of a length of resilient tubing, and to maintain said tubing length in a generally arcuate shape, a length of resilient tubing disposed adjacent said backup means, a drive shaft, means to rotate said drive shaft about the axis thereof, means to engage the other side at said tubing length and progressively deform it along the arc formed by said backup means, said means to engage the other side of said tubing comprising a ring in driven engagement with said shaft, said ring being, at one region about the circumference thereof, in pressurized friction drive relation with said shaft, and a flexible belt element interposed between said ring and said other side of said tubing length, said belt forming part of said means to engage and deform said other side of said tubing length.

16. The invention as claimed in claim 15, in which an elongate core is mounted in said tubing length longitudinally thereof, the outer diameter of said core being substantially smaller than the inner diameter of said tubing.

17. The invention as claimed in claim 15, in which second backup means and a second length of resilient tubing are provided in generally mirror image relationship to those recited above, in which said drive shaft is generally centered relative to said tubing lengths, and is which a plurality of said rings are provided between said shaft and tubing lengths in driven relationship with said shaft, said rings simultaneously engaging both of said tubing lengths.

18. The invention as claimed in claim 17, in which a flexible belt is interposed between said rings and said tubing lengths, and engages said tubing opposite said rings.

* * * * *